US008251026B2

(12) United States Patent
Lee

(10) Patent No.: US 8,251,026 B2
(45) Date of Patent: Aug. 28, 2012

(54) VARIABLE VALVE ACTUATOR

(75) Inventor: Jong Won Lee, Gunpo-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 1021 days.

(21) Appl. No.: 12/208,926

(22) Filed: Sep. 11, 2008

(65) Prior Publication Data

US 2009/0241874 A1 Oct. 1, 2009

(30) Foreign Application Priority Data

Apr. 1, 2008 (KR) ..... 10-2008-0030295

(51) Int. Cl.
*F01L 1/34* (2006.01)

(52) U.S. Cl. ..... 123/90.16; 123/90.15

(58) Field of Classification Search ..... 123/90.15, 123/90.16
See application file for complete search history.

(56) References Cited

U.S. PATENT DOCUMENTS

| | | | | |
|---|---|---|---|---|
| 7,451,729 | B2 * | 11/2008 | Sugiura et al. | 123/90.16 |
| 7,621,242 | B2 * | 11/2009 | Kitagawa et al. | 123/90.16 |
| 7,640,900 | B2 * | 1/2010 | Tateno et al. | 123/90.16 |
| 7,644,689 | B2 * | 1/2010 | Tateno et al. | 123/90.16 |
| 7,814,873 | B2 * | 10/2010 | Tateno et al. | 123/90.16 |
| 7,819,102 | B2 * | 10/2010 | Maehara et al. | 123/90.65 |

FOREIGN PATENT DOCUMENTS

JP 2004-132258 A 4/2004

* cited by examiner

*Primary Examiner* — Thomas Denion
*Assistant Examiner* — Daniel Bernstein
(74) *Attorney, Agent, or Firm* — Morgan, Lewis & Bockius LLP

(57) ABSTRACT

A variable valve actuator presses rocker arms using force transmitted from a drive cam to open/close valves of an engine, and includes a swing arm, which is pivotably coupled to the engine on a first side thereof, and at least two pressing means, which come into contact with the rocker arms on first sides thereof, are pivotably coupled to a second side of a swing arm on second sides thereof, and press the rocker arms when pressed by the drive cam. Thereby, the variable valve actuator can adjust a lift time and a lift distance of each valve without changing positions of the drive cams and the camshaft, and more easily adjust the lift time of each valve, and have very excellent applicability to the engine due to simple internal configuration.

12 Claims, 6 Drawing Sheets

VARIABLE VALVE ACTUATOR

CLAIM OF PRIORITY

This application claims the benefit of Korean Patent Application No. 10-2008-0030295 filed on Apr. 1, 2008, in the Korean Intellectual Property Office, the disclosure of which is incorporated herein by reference.

BACKGROUND OF THE INVENTION

1. Field of the Invention

The present invention relates to a variable valve actuator and, more particularly, to a variable valve actuator, in which the lift time and the lift distance of a valve are varied according to the low-/high-speed operating range of an engine.

2. Description of the Related Art

As for an engine, a camshaft is rotated by a rotating force transmitted from a crank shaft, and an intake valve and an exhaust valve are reciprocated up and down with regular timing by cams of the camshaft. Thereby, intake air is supplied to a combustion chamber, and then combustion gas is exhausted. In this process, a fuel-air mixture is compressed and exploded to generate power.

In this manner, a series of elements such as a drive cam, a camshaft, a tappet, a rocker arm, etc. for operating the intake and exhaust valves is called a valve train.

This valve train will be described below in detail with reference to the accompanying drawings.

FIG. 1 is a side view illustrating a conventional valve train.

As illustrated in FIG. 1, the conventional valve train includes drive cams 12, a camshaft 11, rocker arms 14 and valves 15. The drive cams 12 are coupled to the camshaft 11 at predetermined intervals, and each rocker arm 14 making angular motion with respect to a pivot pin 13 is installed under the corresponding drive cam 12.

Further, the intake port or the exhaust port of a cylinder head is disposed below an outer end of each rocker arm 14 with the valve 15 elastically supported by a valve spring 16. Thus, when the camshaft 11 is rotated, rollers 14*a* of the rocker arms 14 are pushed up and down by the respective drive cams 12 having different radii of rotation. Then, each rocker arm 14 makes angular motion with respect to the corresponding pivot pin 13, and the outer end of each rocker arm 14 applies force to a stem end part of the corresponding valve 15. Thus, the valve 15 is lowered against an elastic force of the valve spring 16. Meanwhile, when a position of each drive cam 12 is changed and thus each rocker arm 14 makes angular motion in an upward direction, the corresponding valve 15 is again raised by the elastic force of the valve spring 16.

In this manner, the intake and exhaust valves are repeatedly opened and closed at regular intervals by the operation of the valve train 10.

However, this ordinary valve train makes a single degree-of-freedom system motion by motion of the cam, so that it is impossible to change the valve train depending on engine operation conditions such as high-speed and low-speed engine operation conditions.

In order to solve this problem, there have been developed a variety of variable valve actuators, each of which is adapted to adjust a lift time and a lift distance of the valve 15 according to the engine speed. However, these variable valve actuators must change positions of the drive cams 12 and the camshaft 11, so that it is difficult to easily apply them to existing mass-produced engines.

Further, these variable valve actuators are designed to merely adjust the lift time of the valve 15 by increasing or decreasing the lift distance of the valve 15, so that it is impossible to more efficiently adjust the lift time of the valve 15.

In addition, the variable valve actuators additionally require separate variable cams in addition to the drive cams 12 coupled to the camshaft 11 in order to adjust the lift distance and the lift time of the valve 15. In this manner, because each valve 15 is equipped with the drive cam 12 and the variable cam, the variable valve actuators have complicated internal configuration.

The information disclosed in this Background of the Invention section is only for enhancement of understanding of the background of the invention and should not be taken as an acknowledgement or any form of suggestion that this information forms the prior art that is already known to a person skilled in the art.

SUMMARY OF THE INVENTION

Embodiments of the present invention has been made to solve the foregoing problems with the prior art, and therefore the present invention is directed to a variable valve actuator, capable of adjusting the lift time and the lift distance of each valve without changing positions of the drive cams and the camshaft, and more stably adjusting the lift time of each valve, and simplifying internal configuration.

According to an aspect of the invention, there is provided a variable valve actuator, which presses rocker arms using force transmitted from a drive cam to open/close valves of an engine. The variable valve actuator includes: a swing arm, which is pivotably coupled to the engine on a first side thereof, and at least two pressing means, which come into contact with the rocker arms on first sides thereof, are pivotably coupled to a second side of the swing arm on second sides thereof, and press the rocker arms when pressed by the drive cam, wherein a position of a contact point between the pressing mean and the drive cam is adjustable.

Here, each of the pressing means may come into contact with the rocker arms at different points according to a pivoting angle of the swing arm, and come into contact with the drive cam at different points according to a pivoting angle of the swing arm.

Further, the pressing means may include a driven roller at the contact point where the pressing means come into contact with the drive cam.

Also, the swing arm may include at least two pivoting bars, first sides of which are pivotably coupled to the engine, and second sides of which extend in a direction of moving away from the valves in a predetermined distance, and at least one connecting bar, which is coupled with the pivoting bars so as to mutually connect the second sides of the pivoting bars.

Further, the pressing means may be pivotally coupled to the connecting bar to press the respective rocker arms.

Further, each of the rocker arms may include a rocker arm roller at the point of coming into contact with each pressing means, and each of the pressing means may include a recessed curved surface that is in contact with each rocker arm roller.

Meanwhile, the variable valve actuator may further include a swinging means, which pivots the swing arm.

Here, the swinging means may include a swing shaft located substantially below the second side of the swing arm, and a first side of a swing cam coupled to the swing shaft and pushing up the second side of each pivoting bar according to a rotating angle of the swing shaft, which is regulated by a signal of a controller.

According to an exemplary embodiment of the present invention, the variable valve actuator can adjust a lift time and a lift distance of each valve without changing positions of the drive cams and the camshaft, and more easily adjust the lift time of each valve, and have very excellent applicability to the engine due to simple internal configuration.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE EXEMPLARY EMBODIMENT

The present invention will now be described more fully hereinafter with reference to the accompanying drawings, in which exemplary embodiments thereof are shown. In the following description of the present invention, a detailed description of known functions and components incorporated herein will be omitted when it may make the subject matter of the present invention rather unclear.

Figure 1:
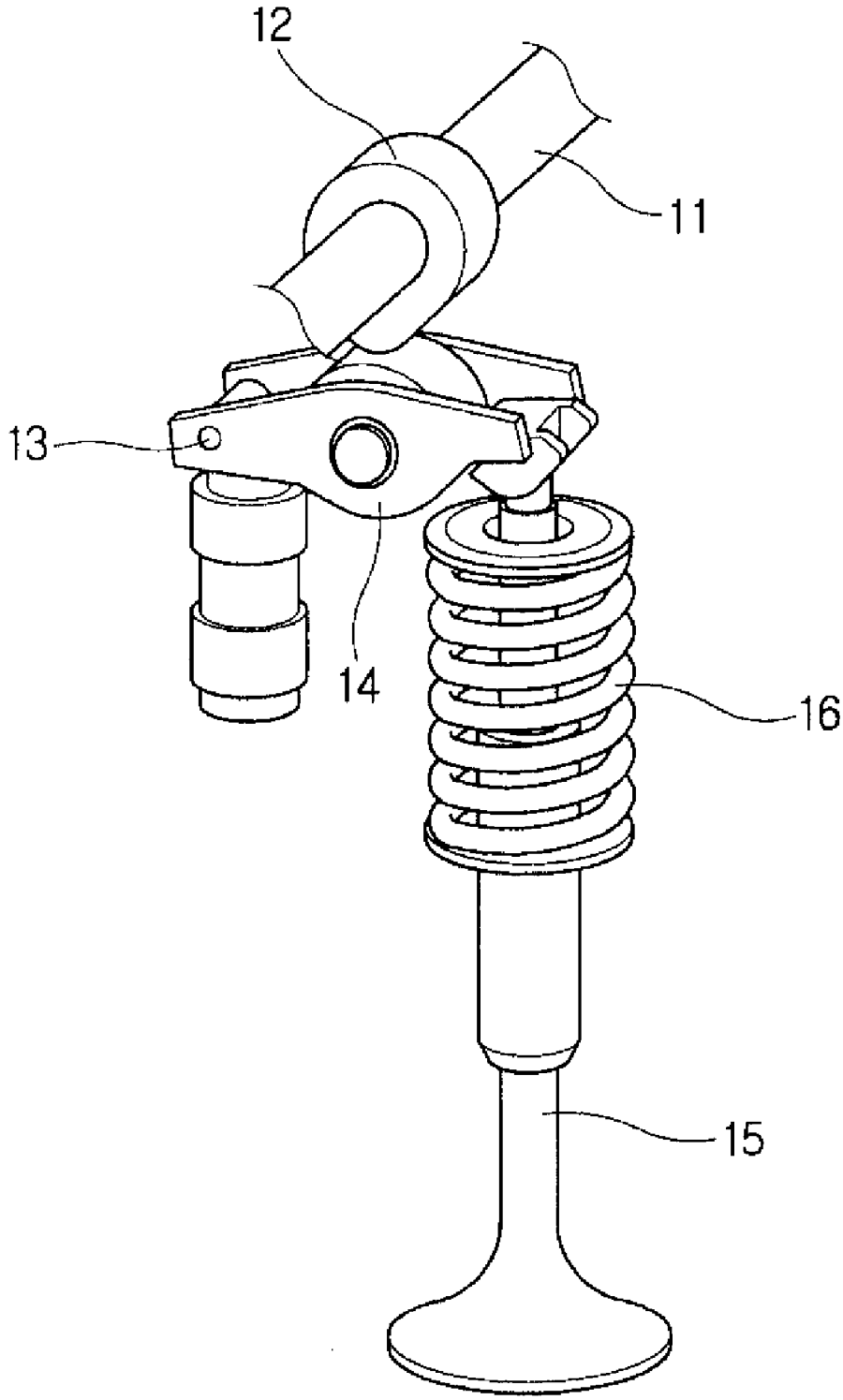
FIG. 1 is a side view illustrating a conventional valve train.
Figure 2:
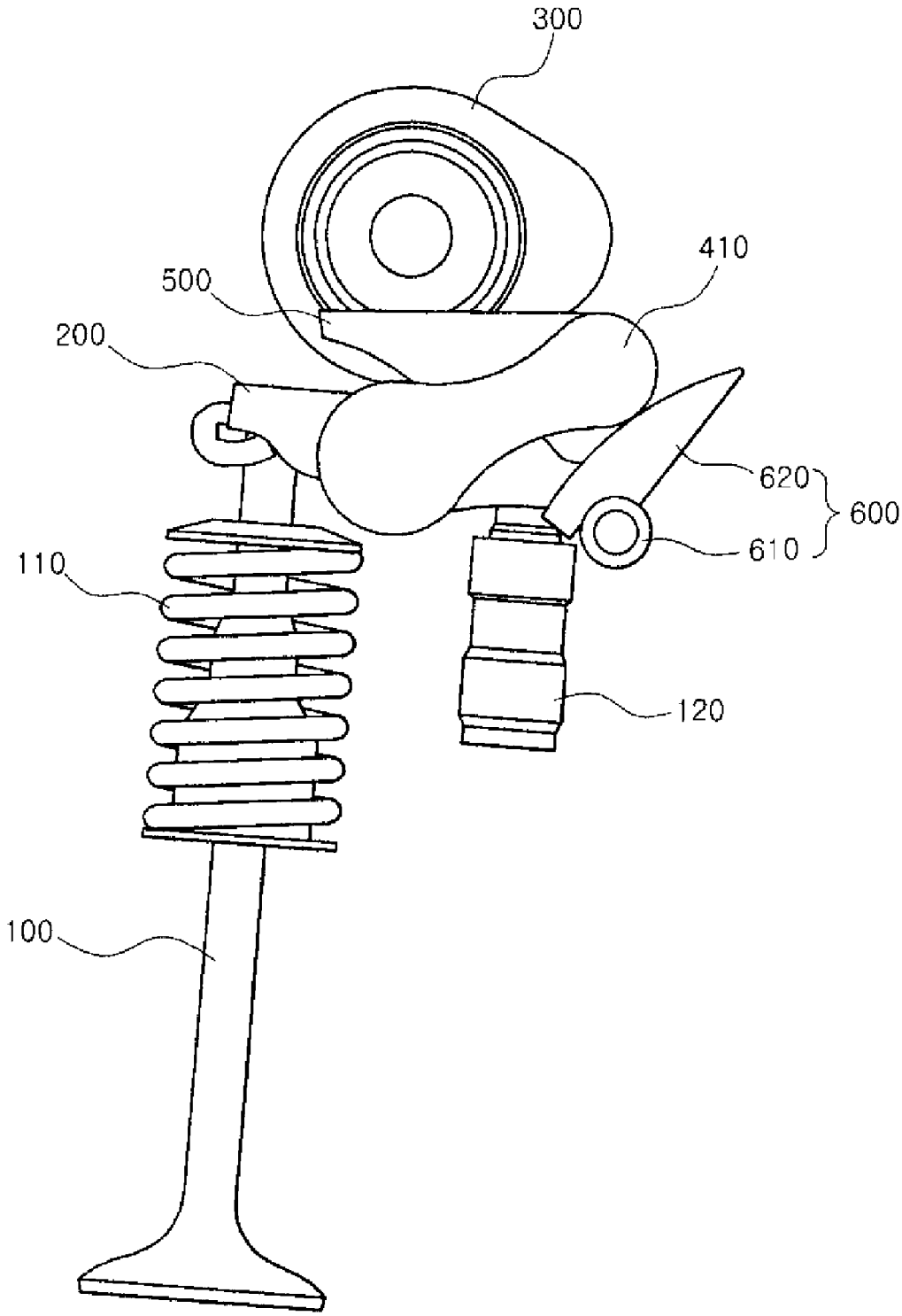
FIG. 2 is a side view illustrating a variable valve actuator according to an exemplary embodiment of the present invention.
Figure 3:
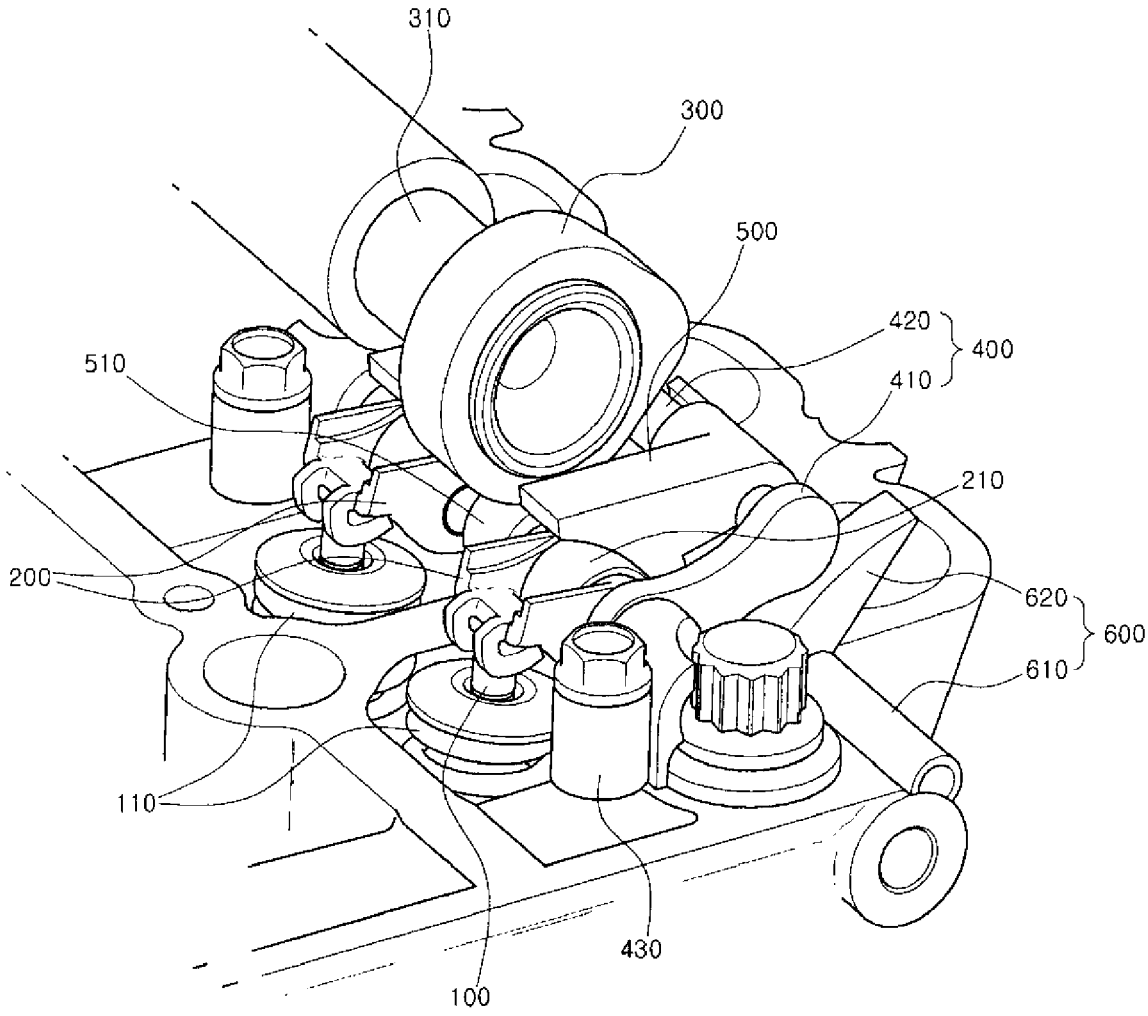
FIG. 3 is a perspective view illustrating the state in which a variable valve actuator is mounted on an engine according to an exemplary embodiment of the present invention.
Figure 4:
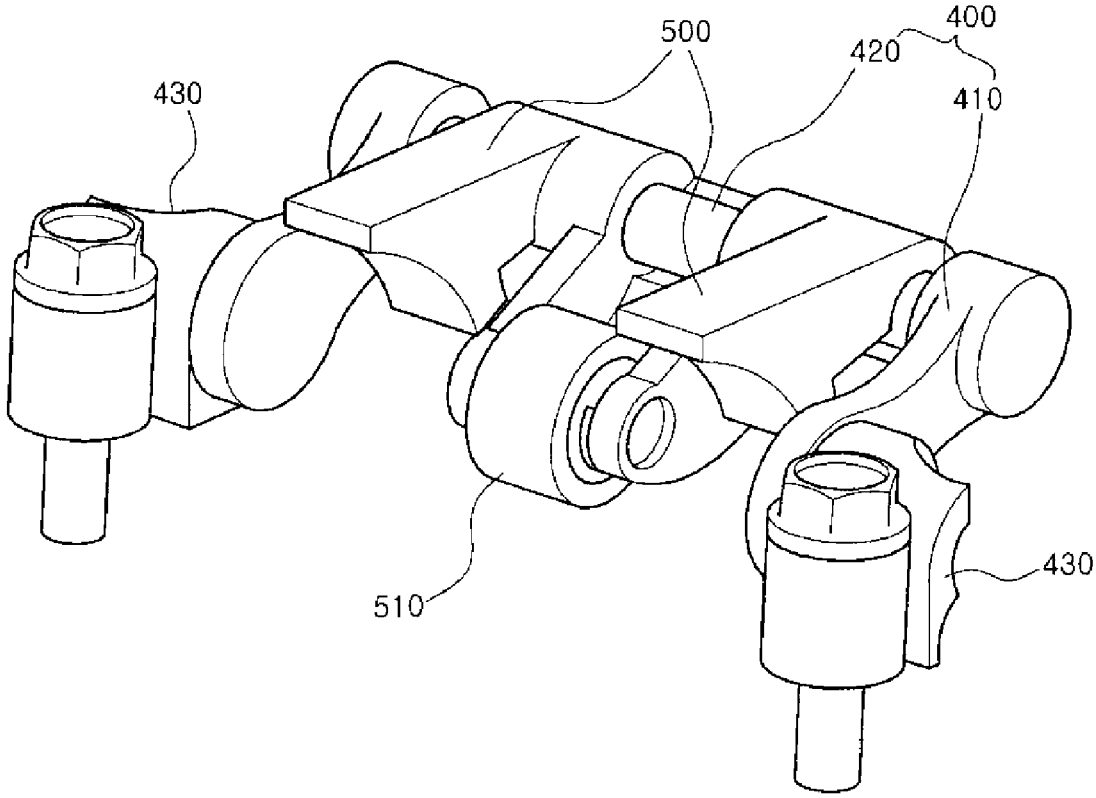
FIG. 4 is a perspective view illustrating a variable valve actuator according to an exemplary embodiment of the present invention.

FIG. 2 is a side view illustrating a variable valve actuator according to an exemplary embodiment of the present invention. FIG. 3 is a perspective view illustrating the state in which a variable valve actuator is mounted on an engine according to an exemplary embodiment of the present invention. FIG. 4 is a perspective view illustrating a variable valve actuator according to an exemplary embodiment of the present invention.

As illustrated in FIGS. 2, 3 and 4, the variable valve actuator according to an exemplary embodiment of the present invention functions to press rocker arms 200 by using force transmitted from a corresponding drive cam 300 mounted on a camshaft 310 to thereby open/close valves 100 of an engine, and includes a swing arm 400, which is pivotably coupled to a cylinder head of the engine on a first side thereof, and pressing means 500, which come into contact with the rocker arms 200 on first sides thereof, are pivotably coupled to the second side of the swing arm 400 on second sides thereof, and press the respective rocker arms 200 when pressed by the drive cam 300.

Each rocker arm 200 is coupled to upper portion of the corresponding valve 100 on a first side thereof (e.g. on a left-hand side thereof in FIG. 2), and comes into contact with a hydraulic valve clearance adjustor 120 on the second side thereof. Further, the valves 100 are lowered by the respective rocker arms 200, and are returned upwards by elastic force of valve springs 110.

The swing arm 400 is for changing a point of time at which the force from the drive cam 300 is transmitted to the pressing means 500, and includes at least two pivoting bars 410 and at least one connecting bar 420 therebetween.

Each pivoting bar 410 is pivotably coupled to a fixing bracket 430 fixed to the engine on a first side thereof (e.g. at a left-hand end thereof in this embodiment), and extends in a direction of moving away from the valve 100 (e.g. in a rightward direction in FIG. 2) on the second side thereof (e.g. at a right-hand end thereof in this embodiment). Further, the connecting bar 420 is coupled with the pivoting bars 410 so as to allow the second ends of the pivoting bars 410 to be connected to each other.

In detail, the swing arm 400 is designed to pivot around a point where it is hinged with the fixing bracket 430, and functions to vary a lift height and a lift time of each valve 100 according to a pivoting angle. The operation and effects of the swing arm 400 will be described below in detail with reference to FIGS. 5 and 6.

Two pressing means 500 are pivotally coupled to the connecting bar 420 on second sides thereof (e.g. at right-hand ends thereof in this embodiment) so as to press the respective rocker arms 200, and is coupled each other with a driven roller 510 therebetween for reducing a frictional force against the drive cam 300 when the driven roller 510 comes in contact with the drive cam 300.

The pressing means 500 are not fixedly coupled to the connecting bar 420 but they are pivotably coupled, i.e. are hinged, to the connecting bar 420. Thus, although the swing arm 400 is pivoted such that the second side of each pivoting bar 410 is raised, the pressing means 500 do not press the rocker arms 200. Only when pressed downwards by the drive cam 300, the pressing means 500 press the rocker arms 200 to open the valve 100.

However, the pivoting angle of the swing arm 400 is changed, the point where the driven roller 510 comes into contact with the drive cam 300 is changed, and the point of time when each pressing means 500 begins to press a corresponding rocker arm 200 (consequently, the point of time when the valve 100 is opened or closed) is changed as well. Thus, the point of the pressing means 500 which comes into contact with the rocker arm 200 (and more particularly, which come into contact with locker arm roller 210) is changed. As a result, the pressed distance of the rocker arm 200 depending on the pivoting of the pressing means 500 (and consequently, the lift distances of the valves 100) is changed.

The operation and effects of these pressing means 500 will be described in detail with reference to FIGS. 5 and 6.

Further, faces of the pressing means 500 which come into contact with the rocker arm rollers 210 may be preferably formed in the shape of a recessed curved surface so as to be able to more stably press the rocker arm rollers 210 even when the points of the pressing means 500 which come into contact with the locker arm rollers 210 are changed.

Although the present embodiment has described only the configuration in which the first sides of the pressing means 500 are lowered by pressing the driven roller 510, it may be configured so that the drive cam 300 directly presses the pressing means 500 without the driven roller 510. Further, the present embodiment has described only the configuration in which one drive cam 300 moves two pressing means 500 in a downward direction, it may be configured so that one drive cam 300 opens and closes at least three valves 100 by coupling at least three pressing means 500 to one swing arm 400, or so that one drive cam 300 moves one pressing means 500 in a downward direction by separately mounting the drive cams 300 on the respective pressing means 500.

According to an exemplary embodiment of the present invention, the variable valve actuator further includes a swinging means 600, which pivots the swing arm 400 so as to allow the swinging means 600 to be automatically pivoted.

The swinging means 600 is for pivoting the swing arm 400, and includes a swing shaft 610 located below the second side of the swing arm 400, and a swing cam 620 coupled to the swing shaft 610 and pushing up the second side of each pivoting bar 410 according to a rotating angle of the swing shaft 610. In detail, when the swing shaft 610 rotates in a counterclockwise direction in the state as illustrated in FIG. 2, the swing cam 620 pushes up the second side of each pivoting bar 410, and thereby the swing arm 400 also rotates in a counterclockwise direction. In contrast, when the swing shaft 610 rotates in a clockwise direction, the swing arm 400 rotates in a clockwise direction due to its self-weight.

At this time, the swinging means 600 is adapted so that its rotation is controlled by a controller so as to be able to rotate at a predetermined angle in a clockwise or counterclockwise direction according to various setting conditions such as a speed of the engine.

FIGS. 5 and 6 are side views illustrating the operation of a variable valve actuator according to an exemplary embodiment of the present invention.

Figure 5A:
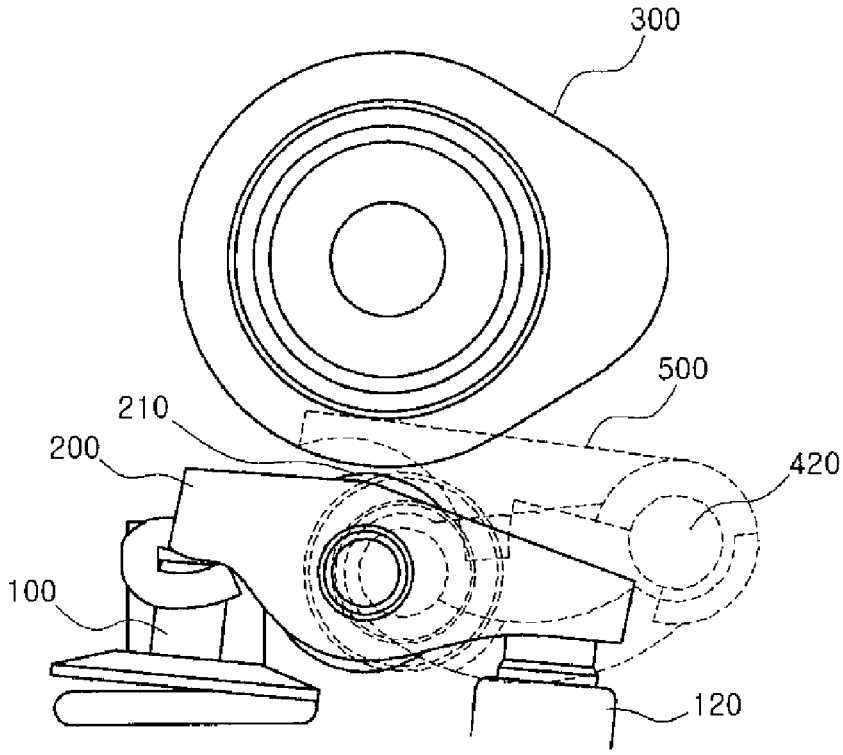
FIGS. 5 and 6 are side views illustrating the operation of a variable valve actuator according to an exemplary embodiment of the present invention.
Figure 5B:
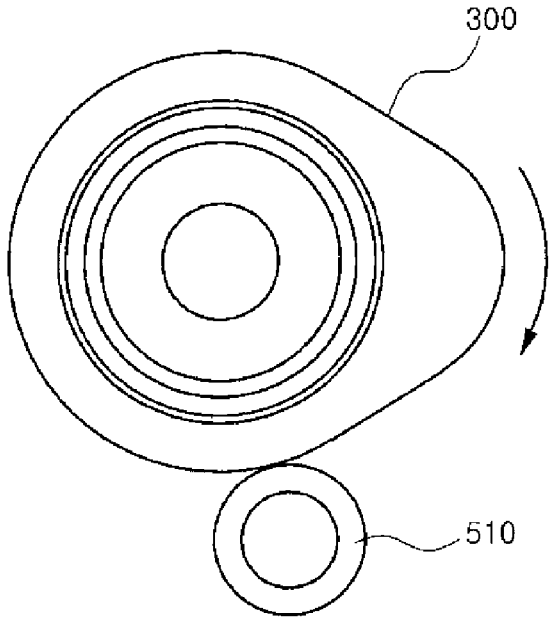

FIG. 5A is a side view illustrating positions of pressing means and rocker arm rollers when a swing arm is rotated such that the second side of a swing arm (e.g. at a right-hand end thereof in this embodiment) moves in a downward direction, and FIG. 5B is a side view illustrating positional relationship between a drive cam and a driven roller in the state as illustrated in FIG. 5A.

In the state as illustrated in FIGS. 5A and 5B, when the drive cam 300 rotates in a clockwise direction, the pressing means 500 (only one pressing means 500 is shown in FIGS. 5A and 5B) move down starting from a point of time at which a protrusion (off-center outer face) of the drive cam 300 comes into contact with the driven roller 510, and the first-side bottom surfaces of the pressing means 500 presses the rocker arm rollers 210 in a downward direction, thereby pivoting the rocker arms 200 and opening the valves 100.

Figure 6A:
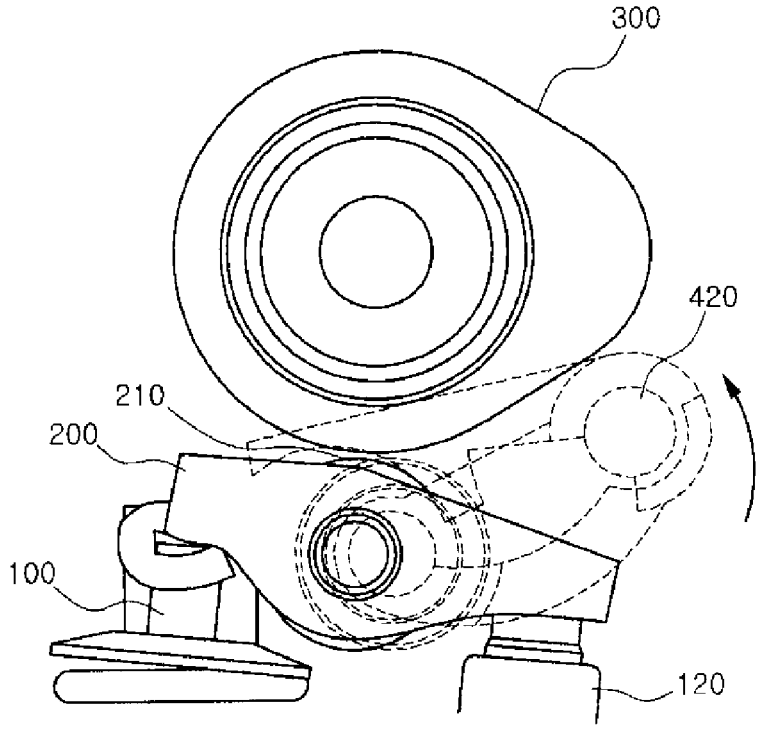
Figure 6B:
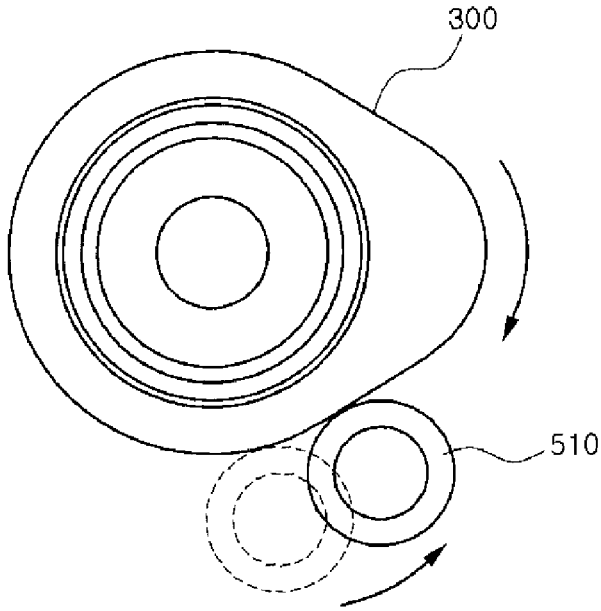

Further, FIG. 6A is a side view illustrating positions of pressing means and rocker arm rollers when a swing arm is rotated such that the second side of a swing arm (e.g. at a right-hand end thereof in this embodiment) moves in an upward direction, and FIG. 6B is a side view illustrating positional relationship between a drive cam and a driven roller in the state as illustrated in FIG. 6A.

As illustrated in FIG. 6A, when the swing arm 400 pivots in a counterclockwise direction, the left-hand ends of the pressing means 500 further press the respective rocker arm rollers 210, compared to that illustrated in FIG. 5A. Thus, the driven roller 510 moves upwards along the outer face of the drive cam 300 as illustrated in FIG. 6B.

At this time, since the right-hand ends of the pressing means 500 are hinged to the connecting bar 420, each pressing means 500 has the radius of rotation in proportion to the distance from the right-hand end thereof. Thus, as illustrated in FIG. 6A, when the left-hand ends of the pressing means 500 press the respective rocker arm rollers 210, the distance at which each rocker arm 200 moves in the downward direction is reduced so much, compared to that illustrated in FIG. 5A. Thus, the lift distance of each valve 100 is reduced.

Further, as illustrated in FIG. 6A. when the swing arm 400 pivots in a counterclockwise direction, the driven roller 510 moves upwards along the outer face of the drive cam 300 as illustrated in FIG. 6B. In this manner, when the position of the driven roller 510 is changed, the driven roller 510 is pressed in a downward direction even when the drive cam 300 is slightly rotated. In other words, as illustrated in FIG. 6A, in the state in which the swing arm 400 pivots in the counterclockwise direction, the valves 100 are faster opened, compared to those illustrated in FIG. 5A.

Consequently, according to the variable valve actuator of the present invention, in the state as illustrated in FIG. 5A, the downwardly moving distance of each valve 100 is increased, while the opening time of each valve 100 becomes late. In the state as illustrated in FIG. 6A, the downwardly moving distance of each valve 100 is decreased, while the opening time of each valve 100 becomes fast.

Thus, when the variable valve actuator of the present invention is used, the downwardly moving distance and the opening time of each valve 100 are property adjusted depending on whether the engine is in a low-speed operating state or a high-speed operating state. Thereby, the exhaust gas can be reduced, and the expenses caused by noble metal used for post-treatment of the exhaust gas can be reduced.

Further, the variable valve actuator of the present invention couples two or more pressing means 500 to one swing arm 400, so that it can operate two or more valves 100 using one drive cam 300, and thus its internal configuration can be made simpler.

In addition, the variable valve actuator of the present invention can be mounted on the engine without changing the positions of the valves 100, the rocker arms 200, the drive cam 300, etc. which have generally been used, so that its applicability to the engines is very excellent.

While the present invention has been described with reference to the particular illustrative embodiments and the accompanying drawings, it is not to be limited thereto. Accordingly, the foregoing embodiments can be suitably modified and altered, and such applications fall within the scope and spirit of the present invention that shall be defined by the appended claims.

What is claimed is:

1. A variable valve actuator, which presses rocker arms using force transmitted from a drive cam to open and close valves of an engine, comprising:

a swing arm, which is pivotably coupled to the engine on a first side thereof;

at least two pressing means, which come into contact with the rocker arms on first sides thereof, are pivotably coupled to a second side of the swing arm on second sides thereof, and press the rocker arms when a fixed point of the at least two pressing means is pressed by the drive cam wherein a position of a contact point between the pressing means and the drive cam is adjustable, wherein the swing arm includes a pivoting bar that is pivotally coupled to the engine and the at least two pressing means; and a swing shaft located substantially below the second side of the swing arm, and a first side of a swing cam coupled to the swing shaft and pushing up the second side of each pivoting bar according to a rotating angle of the swing shaft which is regulated by a signal of a controller.

2. The variable valve actuator according to claim 1, wherein each of the pressing means comes into contact with a corresponding one of the rocker arms at different points according to a pivoting angle of the swing arm, and comes into contact with the drive cam at different points according to a pivoting angle of the swing arm.

3. The variable valve actuator according to claim 2, wherein the swing arm includes at least two pivoting bars, first sides of which are pivotably coupled to the engine and second sides of which extend in a direction of moving away from the valves in a predetermined distance, and at least one connecting bar, which is coupled with the pivoting bars so as to mutually connect the second sides of the pivoting bars.

4. The variable valve actuator according to claim 3, wherein the pressing means are pivotally coupled to the connecting bar to press the respective rocker arms.

5. The variable valve actuator according to claim 2, wherein:

each of the rocker arms includes a rocker arm roller at the point of coming into contact with each pressing means; and each of the pressing means includes a recessed curved surface that is in contact with each rocker arm roller.

6. The variable valve actuator according to claim 1, wherein the pressing means includes a driven roller rotatably attached at the fixed point thereof where the pressing means come into contact with the drive cam.

7. The variable valve actuator according to claim 6, wherein the swing arm includes at least two pivoting bars, first sides of which are pivotably coupled to the engine and second sides of which extend in a direction of moving away from the valves in a predetermined distance, and at least one connecting bar, which is coupled with the pivoting bars so as to mutually connect the second sides of the pivoting bars.

8. The variable valve actuator according to claim 7, wherein the pressing means are pivotally coupled to the connecting bar to press the respective rocker arms.

9. The variable valve actuator according to claim 6, wherein:

each of the rocker arms includes a rocker arm roller at the point of coming into contact with each pressing means; and each of the pressing means includes a recessed curved surface that is in contact with each rocker arm roller.

10. The variable valve actuator according to claim 1, wherein the swing arm includes at least two pivoting bars, first sides of which are pivotably coupled to the engine, and second sides of which extend in a direction of moving away from the valves in a predetermined distance, and at least one connecting bar, which is coupled with the pivoting bars so as to mutually connect the second sides of the pivoting bars.

11. The variable valve actuator according to claim 10, wherein the pressing means are pivotally coupled to the connecting bar to press the respective rocker arms.

12. The variable valve actuator according to claim 1, wherein:

each of the rocker arms includes a rocker arm roller at the point of coming into contact with each pressing means; and each of the pressing means includes a recessed curved surface that is in contact with each rocker arm roller.

* * * * *